US008919316B2

(12) United States Patent
Lehrkamp et al.

(10) Patent No.: US 8,919,316 B2
(45) Date of Patent: Dec. 30, 2014

(54) VALVE SYSTEM FOR CONTROLLING THE CHARGE EXCHANGE

(71) Applicant: Mahle International GmbH, Stuttgart (DE)

(72) Inventors: Arvid Lehrkamp, Winnenden (DE); Alexander Puck, Esslingen (DE); Matthias Vogelsang, Marbach (DE)

(73) Assignee: Mahle International GmbH (DE)

( * ) Notice: Subject to any disclaimer, the term of this patent is extended or adjusted under 35 U.S.C. 154(b) by 0 days.

(21) Appl. No.: 13/774,777

(22) Filed: Feb. 22, 2013

(65) Prior Publication Data

US 2013/0220263 A1 Aug. 29, 2013

(30) Foreign Application Priority Data

Feb. 24, 2012 (DE) ..... 10 2012 202 859

(51) Int. Cl.

| | |
|---|---|
| ***F01L 1/22*** | (2006.01) |
| ***F01L 3/02*** | (2006.01) |
| ***C22C 38/00*** | (2006.01) |
| ***C22C 38/40*** | (2006.01) |
| ***F01L 3/04*** | (2006.01) |
| ***C23C 8/32*** | (2006.01) |
| ***C23C 8/56*** | (2006.01) |
| *C22C 33/00* | (2006.01) |
| *C23C 8/54* | (2006.01) |

(52) U.S. Cl.

CPC ... *F01L 3/04* (2013.01); *F01L 3/02* (2013.01); *C22C 38/001* (2013.01); *C22C 38/40* (2013.01); *C22C 33/00* (2013.01); *C23C 8/32* (2013.01); *C23C 8/54* (2013.01); *C23C 8/56* (2013.01)

USPC ..... 123/188.1; 29/888.06; 29/527.1; 29/557

(58) Field of Classification Search

CPC ..... C22C 33/00; C23C 8/32; C23C 8/54; F01L 3/02; F01L 3/04

USPC ..... 123/188.1, 188.3; 62/217, 222; 29/888.44

See application file for complete search history.

(56) References Cited

U.S. PATENT DOCUMENTS 3,701,652 A * 10/1972 Stanley ..... 420/583
4,801,095 A 1/1989 Banzhaf et al.

(Continued)

FOREIGN PATENT DOCUMENTS

DE 3536452 A1 2/1987
DE 10026721 A1 2/2001

(Continued)

OTHER PUBLICATIONS

English abstract for DE-102005058316, Jun. 21, 2007.

(Continued)

*Primary Examiner* — Noah Kamen
*Assistant Examiner* — Long T Tran
(74) *Attorney, Agent, or Firm* — Rader, Fishman & Gruer pLLC

(57) ABSTRACT

One exemplary illustration of a valve system for controlling the charge exchange in an internal combustion engine may include a valve seat ring and a valve. The valve may have a valve seat configured to form a sealing system with the valve seat ring. The entire valve is nitrocarburized, and a nitrocarburized surface layer is formed on the valve. The nitrocarburized surface layer is produced by a nitrocarburizing method in a salt bath.

10 Claims, 1 Drawing Sheet

(56) References Cited

U.S. PATENT DOCUMENTS

| | | | | |
|---|---|---|---|---|
| 5,934,238 | A | 8/1999 | Wang et al. | |
| 6,318,327 | B1 | 11/2001 | Takahashi et al. | |
| 6,519,847 | B1 * | 2/2003 | Trudeau et al. | 29/888.44 |
| 6,681,735 | B2 * | 1/2004 | Ishihara | 123/90.51 |
| 7,216,427 | B2 * | 5/2007 | Trudeau et al. | 29/888.06 |
| 2002/0050307 | A1 | 5/2002 | Nakamura et al. | |
| 2003/0131473 | A1 * | 7/2003 | Trudeau et al. | 29/888.44 |
| 2004/0118140 | A1 * | 6/2004 | Umemura et al. | 62/217 |
| 2007/0069576 | A1 * | 3/2007 | Suzuki | 303/155 |
| 2008/0149062 | A1 | 6/2008 | Luepfert | |
| 2011/0277887 | A1 | 11/2011 | Foerster et al. | |
| 2012/0304821 | A1 * | 12/2012 | Ando et al. | 75/235 |

FOREIGN PATENT DOCUMENTS

| | | | |
|---|---|---|---|
| DE | 69910273 | T2 | 2/2004 |
| DE | 102005013088 | A1 | 9/2006 |
| DE | 102005058316 | A1 | 6/2007 |
| DE | 102007047074 | A1 | 4/2009 |
| DE | 102008061237 | | 6/2010 |
| DE | 102010002457 | A1 | 9/2011 |

OTHER PUBLICATIONS

English abstract for DE-102010002457, Sep. 1, 2011.

* cited by examiner

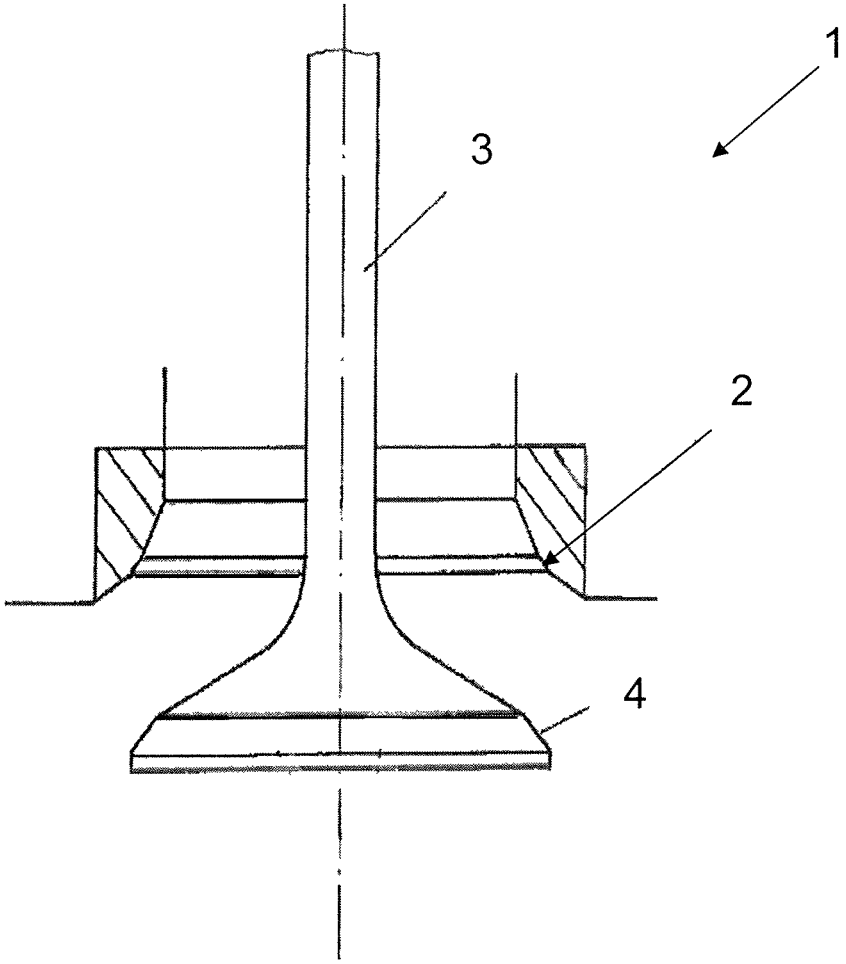
1
3
2
4

VALVE SYSTEM FOR CONTROLLING THE CHARGE EXCHANGE

CROSS-REFERENCE TO RELATED APPLICATIONS

This application claims priority to German Patent Application 10 2012 202 859.5, filed Feb. 24, 2012, which is hereby incorporated by reference in its entirety.

TECHNICAL FIELD

The invention relates to a valve system for controlling the charge exchange in an internal combustion engine, the valve system comprising a valve seat ring and a valve having a valve seat which forms a sealing system together with the valve seat ring.

BACKGROUND

A valve system formed as an intake or exhaust system, hereinafter designated as valve system, for controlling the charge exchange in an internal combustion engine comprises in addition to the intake valves also the exhaust valves. The valve system determines when and how much fresh gas is introduced into the combustion chamber, and it controls when the combusted gas is expelled. On all system components, and in particular on the valve seat ring and the valve seat associated with the valve seat ring, high material requirements are placed. Accordingly, these components must have high fatigue strength and must be mechanically and thermally highly resistant and must have a high wear resistance. For this purpose, depending on the requirements specification, different materials can be combined with each other and the respective positive material properties can be used to optimally support the individual components of a valve system. Thus, for reducing wear and increasing the service life, the valve systems can be further optimized in a requirement-specific manner, for example by hardening the valve seat or build-up welding with a special hard-facing alloy by means of which the valve seat is hard-faced. In order to improve the wear behaviour of the valve stem, said valve stem is often nitrated or chromed.

From U.S. Pat. No. 6,318,327 B1, a valve system for an internal combustion engine is known which comprises a valve seat and a valve element associated with said valve seat, wherein the valve seat has a base element comprising a matrix of iron-based sinter alloy and dispersed therein a powder from an intermetallic compound of the Si—Cr—Mo—Co group, said powder having a hardness of 600 to 1000 HV and an average particle diameter of 20 to 70 μm and being contained in the matrix in an amount of from 10 to 50 percent by mass based on the total mass of the base element. The valve system is characterized in that the valve element has a base element comprising a matrix of martensitic steel and a nitriding diffusion layer formed on a valve surface of the base element, the nitriding diffusion layer having a hardness of more than 500 HV and a thickness of more than 20 μm.

With the nitriding diffusion layer on the valve element in the known valve system, an improved wear and abrasion resistance is achieved; however, temporary adhesive bonding or, respectively, punctual welding of valve seat and valve seat ring cannot be avoided.

SUMMARY

It is an object of the present invention to provide a valve system for controlling the charge exchange in an internal combustion engine, which valve system comprises a valve seat ring and a valve with a valve seat that forms a sealing system together with the valve seat ring, and which, in consideration of the wear caused by the interaction between valve seat and valve seat ring, exhibits a reduced total wear.

The object is achieved by a valve system for controlling the charge exchange in an internal combustion engine, which valve system comprises a valve seat ring and a valve having a valve seat which forms a sealing system with the valve seat ring, and which is characterized in that the valve seat is nitrocarburised.

The invention thus purposely departs from the prior art from which a ground and thus nitride-layer-free valve seat of a nitrided valve is known. Due to tolerance requirements in terms of concentricity between valve seat and valve stem, grinding the valve seat after nitriding and a resulting removal of the existing nitride layer was absolutely necessary. Preferably, the valve of the valve system is not straightened since straightening after forging the valves introduces material stresses in the valve body including the valve seat, which stresses are relieved again during nitriding in the form of deformations. Thus, the tolerance requirements for nitrided valve seats can advantageously be achieved. Straightening is to be understood as cold- or hot-forming of a workpiece with the goal to eliminate bulges and deflections or to restore the desired form. This is in particular to be understood here as a cold-forming of the valve with the goal to restore the concentricity between valve seat and valve shaft to the desired form.

Preferably, apart from the valve seat, the entire valve body is nitrocarburised. Advantageously, by also nitrocarburising the entire valve casing surface in addition to the seat surface, weak points at the transition of a nitrocarburised surface to a non-nitrocarburised surface are avoided. In addition to an improvement of the wear resistance properties of the valve system with unchanging wear resistance requirements, this enables a reduction of the production costs. The nitrocarburised surface layer of the valve body is generated by enriching the skin layer of the material with nitrogen and carbon in a thermochemical treatment, wherein in the compound layer, among other things, iron nitride is formed. By the nitrocarburised surface layer, the resistance against adhesive wear is enhanced.

Preferably, the nitrocarburised surface layer is produced by means of a nitrocarburising method in a salt bath. Therewith, low nitriding temperatures and shorter treatment times can be used. Thus, already at a temperature of 500-550° C. over a period of 40-90 minutes, very good results are achieved. Moreover, the decline of the nitriding hardness profile in the course from the surface into the depth of the workpiece is not as steep as for steels which are only enriched with nitrogen, thus have been purely nitrided, as this is applies, for example, to plasma-nitrided steels. Advantageously, this small gradient of the hardness drop prevents the nitrocarburised layer from chipping off. The flattening of the gradient of the dropping hardness degree is caused by the carbon which diffuses into the material and which is situated below the nitrogen-enriched layer.

By nitriding in the salt bath, a diffusion layer with a thickness of >15 μm and a compound layer with a thickness of up to 3 μm is formed in a martensitic steel; in the case of an austenitic steel, a diffusion layer with a thickness of >5 μm and a compound layer with a thickness of up to 3 μm is formed.

The diffusion layer consists of a layer very rich in nitrogen and an underlying high-carbon layer. Nitrogen and carbon diffuse during the nitrocarburising process into the valve steel. A layer significantly richer in nitrogen, the so-called compound layer, forms above the diffusion layer. The compound layer consists of a chemical compound of the valve steel elements, in particular Fe, Ni and Cr, with the introduced nitrogen. The compound layer of the martensitic steel itself can be divided into an outer compound layer with a porous zone and into a compact, white, at least bright, compound layer. In the case of austenitic steel, the compound layer occurs as a grey zone. The compound layer has no longer a metallic character but rather a ceramic character. This ensures a chemical separation of the contacting metal surfaces of the valve elements, in particular of the valve seat and the valve seat ring, of the valve stem and the valve guide, of the valve grooves and the valve collets, and of the valve stem end face and the actuator element.

Through this separation of the surfaces, adhesive wear, i.e., micro-welding of the surfaces with subsequent tearing out of near-surface grains from the respective contacting valve portion is reduced or prevented. Likewise, due to the high surface hardness of the nitrided layer, the abrasive wear in the valve seat is reduced.

Through this, according to the invention, adhesive bonding of parts of the valve seat or the valve seat ring is effectively reduced or prevented. Through this, wear on a valve system according to the invention can be reduced by up to 85% for intake systems and by up to 90% for an exhaust system. In addition, the total wear of a valve system according to the invention for controlling the charge exchange is reduced. In order to obtain a sufficient hardness in addition to the good wear resistance properties of the valve seat, preferably, alloyed valve steels are used.

In a particularly preferred embodiment of a valve system according to the invention, at least the valve steel is a Cr—Mn—Ni-alloyed austenitic valve steel, wherein an up to 3 μm thick compound layer of the nitrocarburised valve, comprising the valve seat and the valve stem, consists of at least 10-65% by weight of Fe, 0.4-40% by weight of N, 10-22% by weight of Cr, 0.1-10% by weight of Mn, 0.1-5.5% by weight of Ni and 0.45%-16% by weight of C. Below the compound layer, the valve steel has a >15 μm thick diffusion layer.

In a further particularly preferred embodiment of a valve system according to the invention, at least the valve comprising the valve seat is made from a Cr—Si-alloyed martensitic valve steel, wherein an up to 3 μm thick compound layer of the nitrocarburised valve, in particular of the valve seat and the valve stem, consists of at least 10-90% by weight of Fe, 10-30% by weight of N, 2.5-10% by weight of Cr and 0.5-10% by weight of Ni. Below the compound layer, the valve steel has a >15 μm thick diffusion layer.

The valve steel is preferably X45CrSi9-3, X50CrMnNiNb21-9 or NIREVA 3015 (UNS-#66315). A hard-facing material is, for example, X180Fe—CoNiMo50-28 12 5. The aforementioned valve steels are particularly well suited for achieving a wear-resistant surface layer through nitrocarburising because they contain at least one nitride former such as Fe and Cr.

An advantageous configuration provides that the nitrocarburised surface layer has a hardness of 400 to 1200 HV. Such a hardness of a nitrocarburised surface effects very high resistance with respect to adhesive wear.

The principle and further characteristic features of the present invention arise in more detail from the following description. Moreover, further embodiments are illustrated which, individually or in combination, lead to the solution according to the invention.

BRIEF DESCRIPTION OF THE DRAWINGS

Here it shows, in each case schematically:

FIG. 1 is an exemplary valve system.

DETAILED DESCRIPTION

FIG. 1 shows a valve system according to the invention for controlling the charge exchange in an internal combustion engine. The valve system 1 has a valve seat ring 2 and a valve 3 with a valve seat 4. The valve seat 4 forms a sealing system together with the valve seat ring 2. The valve seat 4 has a substantially rotationally symmetric shape and is nitrocarburised according to the invention.

In a closed valve position, the valve seat 4 rests against the valve seat ring 2 and thus closes the combustion chamber, which is not illustrated in the figure. The valve system 1 shown in FIG. 1, and in particular the valve 3, consists completely of a sinter material on the basis of a steel powder. The valve 3 is a forged part so that tight tolerances can be met during the production, and straightening can be avoided where applicable. In a final machining operation by grinding and turning all valve surfaces, wherein primarily the valve stem end face, the valve grooves, the valve stem and the valve seat 4 are relevant in terms of function, according to the invention, the entire valve 3 is nitrocarburised in a salt bath and finally measured and inspected.

The valve is then ready to be installed for engine operation. In individual cases, the valve stem is polished for reducing the roughness. However, no production process that completely removes the nitrided layer takes place after nitriding.

The valve consists, for example, of a Cr—Mn—Ni-alloyed austenitic steel or a Cr—Si-alloyed steel, optionally with additional nitride formers. To the seat ring material, alloying elements can be admixed such as, for example, Fe, Cu, Ni, Cr, Mo, Co, W, V, C, Mn or Si.

The invention claimed is:

1. A valve system for controlling the charge exchange in an internal combustion engine, comprising:

a valve seat ring; and a valve having a valve seat configured to form a sealing system with the valve seat ring;

wherein the entire valve is nitrocarburized;

wherein a nitrocarburised surface layer is formed on the valve, the nitrocarburised surface layer being produced by a nitrocarburising method in a salt bath.

2. The valve system according to claim 1, wherein the valve of the valve system is not straightened.

3. The valve system according to claim 2, wherein the valve includes a Cr—Mn—Si-alloyed austenitic valve steel, and the nitrocarburised valve seat includes approximately a 3 μm thick compound layer including at least 10-90% by weight of Fe, 10-30% by weight of N, 2.5-10% by weight of Cr and 0.5-10% by weight of Ni, and further wherein approximately a >15 μm thick diffusion layer is formed below the compound layer.

4. The valve system according to claim 1, wherein the valve includes a Cr—Mn—Si-alloyed austenitic valve steel, and the nitrocarburised valve seat includes a 3 μm thick compound layer including at least 10-90% by weight of Fe, 10-30% by weight of N, 2.5-10% by weight of Cr and 0.5-10% by weight of Ni, and further wherein a >15 μm thick diffusion layer is formed below the compound layer.

5. The valve system according to claim 4, wherein the valve includes a Cr—Si-alloyed martensitic valve steel, and the nitrocarburised valve seat includes approximately a 3 μm thick compound layer including at least 10-90% by weight of Fe, 10-30% by weight of N, 2.5-10% by weight of Cr and 0.5-10% by weight of Ni, and wherein approximately a >15 μm thick diffusion layer is formed below the compound layer.

6. The valve system according to claim 1, wherein the nitrocarburised surface layer has a hardness of approximately 400 to 1200 HV.

7. A valve system for controlling the charge exchange in an internal combustion engine, comprising:

a valve seat ring; and a valve having a valve seat configured to form a sealing system with the valve seat ring;

wherein the valve of the valve system is not straightened;

wherein the entire valve is forged and nitrocarburised;

wherein a nitrocarburised surface layer is formed on the valve, the nitrocarburised surface layer being produced by a nitrocarburising method in a salt bath.

8. The valve system according to claim 7, wherein the valve includes a Cr—Mn—Si-alloyed austenitic valve steel, and the nitrocarburised valve seat includes a 3 μm thick compound layer including at least 10-90% by weight of Fe, 10-30% by weight of N, 2.5-10% by weight of Cr and 0.5-10% by weight of Ni, and further wherein a >15 μm thick diffusion layer is formed below the compound layer.

9. The valve system according to claim 8, wherein the valve includes a Cr—Si-alloyed martensitic valve steel, and the nitrocarburised valve seat includes approximately a 3 μm thick compound layer including at least 10-90% by weight of Fe, 10-30% by weight of N, 2.5-10% by weight of Cr and 0.5-10% by weight of Ni, and wherein approximately a >15 μm thick diffusion layer is formed below the compound layer.

10. The valve system according to claim 7, wherein the nitrocarburised surface layer has a hardness of approximately 400 to 1200 HV.

* * * * *